US007820256B2

(12) United States Patent
Eisen

(10) Patent No.: US 7,820,256 B2
(45) Date of Patent: Oct. 26, 2010

(54) STIRRING ROD

(76) Inventor: Ewald Eisen, Blutenstrabe 8, Grafensteinberg (DE) 91729

( * ) Notice: Subject to any disclaimer, the term of this patent is extended or adjusted under 35 U.S.C. 154(b) by 363 days.

(21) Appl. No.: 12/002,802

(22) Filed: Dec. 18, 2007

(65) Prior Publication Data

US 2009/0155503 A1 Jun. 18, 2009

(51) Int. Cl.
*A47G 19/30* (2006.01)
*A47G 23/00* (2006.01)

(52) U.S. Cl. ..... 428/34.1; 366/129; 366/343

(58) Field of Classification Search ..... 428/34.1, 428/13; 366/129, 343; 40/409; 446/267
See application file for complete search history.

(56) References Cited

FOREIGN PATENT DOCUMENTS

DE 202006008016 U1 * 8/2006

* cited by examiner

*Primary Examiner*—Alexander Thomas
(74) *Attorney, Agent, or Firm*—Edwards Angell Palmer & Dodge LLP; Jeffrey D. Hsi; Catherine J. Toppin

(57) ABSTRACT

The invention relates to a rod, particularly a stirring rod for liquids, said stirring rod comprising a hollow structure, which is made of transparent material and the interior of which is filled with liquid and/or gas, and in which is present at least one solid body, at least one other solid body forming a hollow space being provided in the hollow structure of the rod instead of or in addition to the solid bodies, and other solid bodies being located inside the hollow space of the body.

12 Claims, 3 Drawing Sheets

STIRRING ROD

Figure 1:
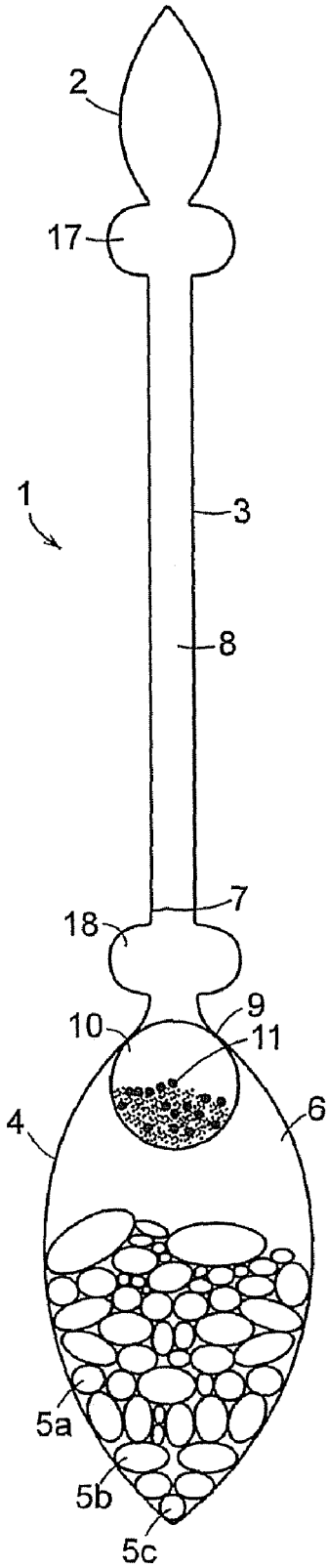

The present invention relates to a rod, in particular a stirring rod for liquids, said stirring rod comprising a hollow structure, which is made of transparent material and the interior of which is filled with liquid and/or gas, and in which at least one solid body is present.

Such rods are used in households, the food service industry, and during public events.

A corresponding rod is disclosed in DE 20 2006 008 016 U1. The rod is made of glass and contains a plurality of solid bodies, such as precious stones and semi-precious stones, which are located in the expanded region of the rod and are surrounded by liquid. The liquid is usually water. If solid bodies which are prone to oxidation are used, these can result in oxidation even though the solid bodies are completely embedded in the liquid filling. Such oxidation processes subsequently affect the optical properties of the rod.

It is the object of the present invention to prevent the afore-mentioned disadvantages associated with similar rods disclosed in the prior art.

This object is achieved using a rod of the type mentioned in the introduction by providing at least one other solid body which forms a hollow space in the hollow structure of the rod instead of or in addition to the solid bodies and by providing solid bodies inside the hollow space of the body. It is thus possible to also receive those solid bodies in the rod that are highly prone to oxidation. The body forming the hollow space shields the solid bodies from the liquid filling.

The body is expediently provided with a transparent design. It is made, for example, of glass, so that the solid bodies located in the body are visible from the outside.

According to a preferred embodiment, the hollow space of the body is under vacuum.

Alternatively, the hollow space of the body can also be filled with a non-oxidizing gas, in particular an inert gas.

The body can have a spherical shape by way of example so that it is completely located in the region of the liquid filling of the rod and thus bring about an optical separation of the solid particles of the body from the solid particles of the rod.

Alternatively, the body can also be provided with an elongated shape resembling a tube with rounded ends and be disposed vertically inside the hollow structure. There results a design effect to the effect that the different solid bodies are located in an orderly structure next to each other without overlapping or blending into each other.

If the material of the body has a higher melting point than that of the rod, for example, by the use of types of glass having varying melting points, there are advantages with respect to the production process.

Furthermore, the diameter of the body is expediently larger than the diameter of the elongated neck region, which connects the handle region to the hollow space. As a result, the body cannot penetrate into the neck region.

The solid bodies located inside the body are advantageously stones, particularly semi-precious stones or precious stones.

The present invention further claims an arrangement comprising a rod and a carafe for receiving the rod, there being provided holding means, which fix the rod located in the carafe in a stable position against the carafe so that the rod is prevented from falling forward when pouring drinks from the carafe. The rod and/or the carafe are thus protected from damage and destruction.

According to a preferred embodiment of the present invention, the holding means engage around the neck region 4 and the handle of the carafe.

Figure 2:
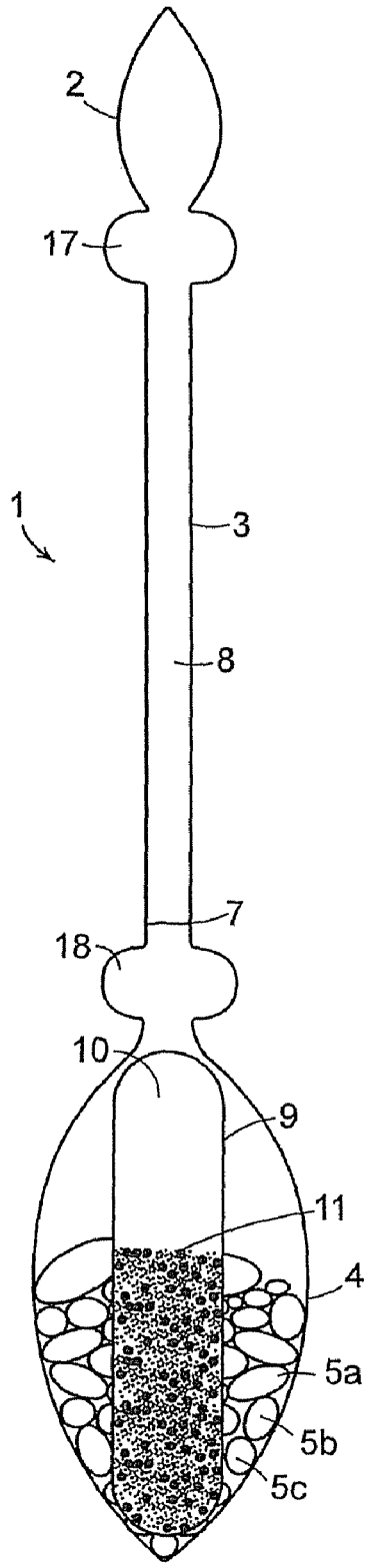
Figure 3:
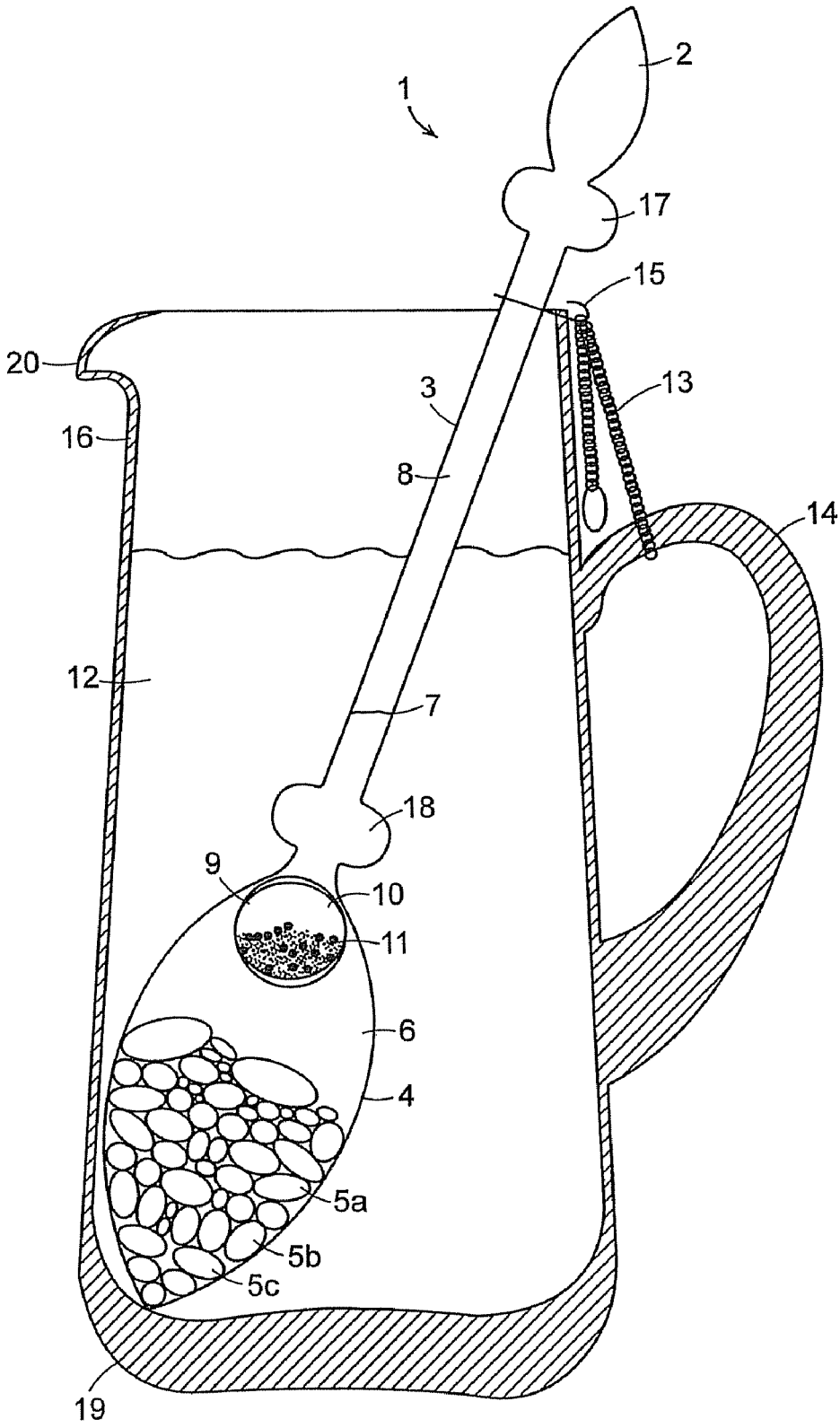

Preferred embodiments of the present invention will be explained in more detail below with reference to the figures of the drawings, in which:

FIG. 1 shows the rod of the invention according to a first embodiment of the present invention, FIG. 2 shows the rod of the invention according to a second embodiment of the present invention, and FIG. 3 is an illustration of an arrangement comprising a carafe and the rod of the embodiment shown in FIG. 1.

The rod 1 in FIG. 1 is designed to be made from hollow bodies. At its upper end, it comprises a handle 2, which is designed as a thickened portion of the hollow structure.

At the opposite end of the handle 2, there is located an expanded region 4, which has a drop-like shape with a tapering tip on its lower side. Between the expanded region 4 and the handle 2, there runs an elongated neck region 3, which comprises bulges 17, 18 on each of its ends.

The diameter of the neck region 3 is about three to five times smaller than that of the expanded region 4.

The typical dimensions of the rod 1 and its sections are described in DE 20 2006 008 016 U1, the disclosure of which is incorporated herein by reference.

The rod is filled with both a liquid 6 and a gas 8. The reference numeral 7 indicates the upper liquid limit, which is shown in FIG. 1 only by way of example at the affected location. Thus, said upper liquid limit can also be located, for example, further above in the neck region 3. An example of the liquid 6 located inside the expanded region 4 is water. The gas 8 located inside the rod is air by way of example.

A plurality of solid bodies, e.g., 5*a*, 5*b*, and 5*c* is located in the expanded region 4 that is filled with liquid 6. These solid bodies 5*a*, 5*b*, and 5*c* are completely surrounded by liquid 6. When using the rod 1, for example, for stirring a liquid, these solid bodies can move inside the expanded region 4. They briefly float in the liquid 6 and then settle again. Thus they constantly change their position in the course of the use of the rod 1.

In the embodiment shown in FIG. 1, there is located another body 9 in the form of a hollow body inside the expanded region 4. This body 9 is likewise surrounded by liquid 6 preferably in its entirety. In the additional body 9, there is located at least one, preferably a plurality of solid bodies 11, which are partitioned off from the liquid 6 present in the expanded region 4 by the presence of the body 9.

The body 9 is evacuated or filled with a non-oxidizing gas, such as an inert gas, by way of example.

The body 9 is made of transparent material just like the rod 1. For example, both the rod and the body 9 are made of glass. The glass of the body 9 expediently has a higher melting temperature than the glass used for the remaining components of the rod 1.

The solid bodies 5*a*, 5*b*, and 5*c* are, for example, stones, in particular semi-precious stones or precious stones. The solid bodies 11 inside the body 9 are expediently objects that are prone to oxidation or stones, in particular semi-precious stones or precious stones that are prone to oxidation.

The difference between the embodiment shown in FIG. 2 and that shown in FIG. 1 is that the body 9 in FIG. 2 has an oblong, tubular shape. Due to this, the solid bodies 11 appear to be geometrically ordered in relation to the solid bodies 5*a*-5*c* of the expanded region 4, the partition wall optically fading into the background due to its transparency. In the embodiment shown in FIG. 2, the body 9, due to its shape, is retained inside the expanded region 4.

FIG. 3 shows an arrangement comprising a carafe 16 and a rod 1 according to the first embodiment of the invention described above.

The carafe 16 comprises roundings 19 in its base region. These roundings 19 are provided with large radii and they prevent the rod 1 from striking against the base of the carafe with great force. Reference numeral 12 indicates the liquid, which is located in the carafe and surrounds the expanded region 4 and a part of the neck region 3.

On the upper side, there is located a hook 15, which engages around the neck region 3 and rests against the upper edge of the carafe 16. The rod 1 is attached to the carafe handle 14 by means of the hook 15 and a holding chain 13. Thus, the rod 1 cannot move forward toward the spout 20 when the liquid is being poured out of the carafe.

LIST OF REFERENCE NUMERALS

1 Rod
2 Rod handle
3 Neck region
4 Expanded region
5 Solid body
6 Liquid filling
7 Liquid limit
8 Gas
9 Body
10 Hollow space
11 Solid body
12 Liquid
13 Holding chain
14 Carafe handle
15 Hook
16 Carafe
17 Bulge
18 Bulge
19 Rounding
20 Spout

The invention claimed is:

1. A rod for stirring liquids, said rod comprising:

a neck portion; and a stirring portion having a first hollow chamber defined therein, the stirring portion being made of transparent material and the first hollow chamber being filled with a liquid and/or a gas, the first hollow chamber having at least one first solid body provided therein, the rod further comprising at least one second hollow chamber is defined within the first hollow chamber, the second hollow chamber having at least one second solid body provided within the second hollow chamber.

2. The rod according to claim 1, wherein the second hollow chamber is transparent.

3. The rod according to claim 1, wherein a space within the second hollow body is under vacuum.

4. The rod according to claim 1 or 2, wherein a non-oxidizing gas is located inside the second hollow chamber.

5. The rod according to claim 4, wherein the second hollow chamber has a spherical shape.

6. The rod according to claim 1, wherein the second hollow chamber has an oblong shape.

7. The rod according to claim 1, wherein a diameter of the second hollow chamber is larger than a diameter of the neck portion.

8. The rod according to claim 1, wherein a material of the second hollow chamber has a higher melting point than a material of the rod.

9. The rod according to claim 1, wherein the at least one second solid body is a stone.

10. An apparatus comprising:

a rod according to claim 1 and a carafe having an inner surface and an outer surface, said carafe being adapted and configured to receive the rod, said apparatus comprising a holding means provided on the outer surface of the carafe, which secures the rod within the carafe in a stable position on the inner surface of the carafe.

11. The apparatus according to claim 10, wherein the carafe further comprises a handle on the outer surface of the carafe, the holding means being attached to the handle, and the holding means being adapted and configured to engage the rod around the neck portion.

12. The apparatus according to claim 11, wherein the holding means comprises a hook for securing the rod around the neck portion.

* * * * *